United States Patent [19]

May et al.

[11] 4,371,860

[45] Feb. 1, 1983

[54] SOLDERABLE VARISTOR

[75] Inventors: John E. May, Skaneateles; Steven R. Zohler, North Syracuse, both of N.Y.

[73] Assignee: General Electric Company, Syracuse, N.Y.

[21] Appl. No.: 334,627

[22] Filed: Dec. 28, 1981

Related U.S. Application Data

[63] Continuation of Ser. No. 49,223, Jun. 18, 1979, abandoned.

[51] Int. Cl.[3] ..... H01C 7/12

[52] U.S. Cl. ..... 338/21; 338/275

[58] Field of Search ..... 338/2, 21, 275; 29/610 R

[56] References Cited

U.S. PATENT DOCUMENTS

| | | | |
|---|---|---|---|
| 2,473,887 | 6/1949 | Jannings et al. | 228/215 |
| 2,501,322 | 3/1950 | Ferguson et al. | 338/21 |
| 3,179,634 | 4/1965 | Edwards | 174/110 N X |
| 3,268,653 | 8/1966 | McNutt | 228/215 X |
| 3,764,951 | 12/1973 | Tachibana et al. | 338/21 X |
| 3,767,282 | 10/1973 | Poley et al. | 228/215 X |
| 3,768,058 | 10/1973 | Harnden, Jr. | 338/20 |
| 3,771,091 | 11/1973 | Harnden, Jr. | 338/20 |
| 3,903,494 | 9/1975 | May | 338/21 X |
| 3,905,006 | 9/1975 | Matsuoka et al. | 338/21 |
| 3,913,222 | 10/1975 | Bernard | 228/215 X |
| 3,928,245 | 12/1975 | Fishman et al. | 338/21 X |
| 4,031,498 | 6/1977 | Hayashi eta l. | 338/21 |
| 4,064,475 | 12/1977 | Kouchich et al. | 338/20 |
| 4,069,465 | 1/1978 | Kouchich et al. | 338/20 |
| 4,087,906 | 5/1978 | Cobaugh et al. | 228/215 X |
| 4,148,135 | 4/1979 | Sakshang et al. | 338/21 X |

FOREIGN PATENT DOCUMENTS

| | | | |
|---|---|---|---|
| 52-51569 | 4/1977 | Japan | 228/215 |
| 7507645 | 1/1976 | Netherlands | 338/21 |

*Primary Examiner*—C. L. Albritton

*Attorney, Agent, or Firm*—Robert J. Mooney

[57] ABSTRACT

A low leakage varistor which is resistant to the high temperature, corrosive conditions encountered during assembly of such devices includes a protective layer disposed on the surface of the varistor body between first and second, spaced-apart electrodes. Both, varistors with electrodes on opposing major surfaces and varistors with laterally spaced electrodes on a single surface are described.

1 Claim, 5 Drawing Figures

SOLDERABLE VARISTOR

This is a continuation of application Ser. No. 49,223, filed June 18, 1979, now abandoned.

This invention relates in general to metal oxide varistors and more particularly to such varistors having a protective coating thereon which enhances the operation of the varistors, especially when the assembly thereof includes a soldering operation.

Although only a relatively brief time has passed since their invention (see for example U.S. Pat. No. 3,496,512) metal oxide varistors and especially zinc oxide varistors have gained wide-spread acceptance as devices for providing a nonlinear resistance function. The electrical characteristics of such voltage dependent resistors are expressed in part by the relation:

$$I=(V/C)^{\alpha}$$

Where V is the voltage across the varistor, I is the current flowing through the varistor, C is a constant corresponding to the voltage at a given current, and the exponent $\alpha$ has a numerical value greater than 1. The value of $\alpha$ is calculated according to the following relation:

$$\alpha = \frac{\log_{10}(I_2/I_1)}{\log_{10}(V_2/V_1)}$$

where $V_1$ and $V_2$ are the voltage at currents $I_1$ and $I_2$, respectively. The desired value for C depends upon the type of application in which the varistor is to be used. It is ordinarily desirable that the value of $\alpha$ be as large as possible since this exponent determines the degree to which the varistors depart from ohmic characteristics.

An additional important characteristic of varistors, and one to which this invention is particularly addressed, is the leakage current of the device which is the current through device at a particular applied voltage which voltage is below the maximum voltage to which the varistor will be subjected in operation in the absence of transients which are desired to be suppressed. The lower the leakage current of a varistor, the less power will be dissipated therein in normal operation. Although substantial effort on the part of many investigators has led to ever-increasing understanding of the characteristics and methods of operation of metal oxide varistor and, especially, of zinc oxide varistors, the device is, nevertheless, not completely understood. For this reason, many significant improvements in varistor operation are made more or less heuristically, and the reasons for the improvement or mechanism for the accomplishment thereof are not always known with complete certainty.

An important method for making electrical contact to metal oxide varistors is by the application of electrodes to one or more surfaces thereof, followed by the attachment of electrically conductive leads to the electrodes, typically by soldering. Silver and aluminum electrodes are commonly employed. While varistors having silver or aluminum electrodes are known to provide a satisfactory operation, it will be understood that other electrode materials may also be employed, and that this invention is not limited to any particular electrode material. Th soldering of an electrically conductive wire lead to a silver electrode is commonly accomplished through the use of lead-tin eutectic solder which may or may not contain additional constituents such as silver to enhance solderability. The soldering operation is carried out at an elevated temperature and oftentimes in the presence of a cleansing agent or flux which enhances the wettability of the solder-electrode interface.

It has been discovered that the process of soldering electrically conductive wire leads to the electrodes frequently has a deleterious effect on the leakage current of varistors. This effect has not heretofore apparently been recognized or in any event identified as a cause of high leakage current in varistors of the type to which this invention is addressed. In view of the relatively low temperature at which soldering is carried out; i.e., a few hundred degrees Celsius, compared to the sintering temperature of varistors; i.e., in excess of 1000° C., it is at least somewhat surprising that degradation of the electrical characteristics of a metal oxide varistor occurs during soldering.

It is an object, therefore, of this invention to provide a metal oxide varistor which maintains a low leakage current characteristic after the use of solder and flux for attaching leads thereto.

It is another object of this invention to provide a solderable varistor which is easy to manufacture and inexpensive.

It is still another object of this invention to provide a metal oxide varistor which exhibits high stability during a long operating life.

Briefly stated and in accordance with one aspect of this invention, a metal oxide varistor characterized by low leakage current which maintains such low leakage current even after the attachment of wire leads thereto by soldering, comprises a varistor body having first and second spaced-apart electrodes applied to the body, and a layer of silicone polyimide covering the body of said varistor pellet between said electrodes. Electrical connection is made to the electrodes by soldering conductive electrical leads thereto which soldering may include, without degradation of the varistor characteristics, the use of flux.

In accordance with a preferred embodiment of this invention, the protective layer covers essentially the entire non-electroded surface of the varistor body as well as a small portion of the edge of the electrodes.

One or more layers of protective material may be employed and the invention may be used on varistors having electrodes on opposing major faces of a varistor body, wherein the protective layer is applied to the periphery of the body, or to varistors having two or more, spaced-apart electrodes on a single surface of the varistor body in which case the protective layer is applied to the surface of the body between the electrodes.

The features of the invention which are believed to be novel are pointed out with particularity in the appended claims. The invention itself, however, both as to its organization and method of operation together with further objects and advantages thereof may best be understood by reference to the following description taken in connection with the accompanying drawings in which:

Figure 1:
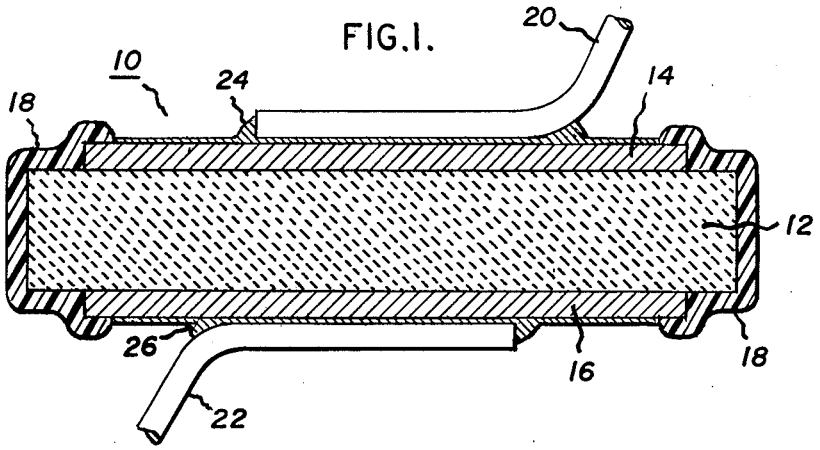
FIG. 1 is a view of a metal oxide varistor having a solderability enhancing coating thereon in accordance with this invention.

Referring now to FIG. 1, there is shown a metal oxide varistor 10 which includes a body portion 12 which is preferably a sintered body composed essentially of a metal oxide such as zinc oxide and a plurality of preselected additives. Methods for manufacturing body 12 are well known to those skilled in the art and, therefore, will not be extensively described herein. Generally, by way of example and not of limitation, the formation of body 12 includes mixing of the major constituents and additives which are then calcined, ground, and pressed into a "green" varistor pellet and sintering the pellet at a high temperature to provide a body having the desired varistor characteristics. Varistor 10 further includes first and second electrodes 14 and 16 which are applied to opposite major surfaces of body 12. Conveniently, and again by way of example rather than of limitation, electrodes 14 and 16 may be silver paint electrodes which are applied to the surfaces of varistor body 12 by silk screening, or the like, and fired at a relatively high temperature such as 800° C. to provide electrical contact to the varistor body.

The steps for forming a varistor in accordance with this invention thus far recited do not substantially deviate from those known in the prior art. It is in the steps which follow that this invention lies. According to the prior art, the varistor with electrodes attached was joined with a pair of metal leads by soldering, or the like. Typically, the soldering process employs a flux to enhance solderability. Prior to this invention, the use of flux in the soldering process had not been linked with any detrimental effect on the varistor characteristics. Now, it has been discovered that the leakage current of metal oxide varistors increases during the soldering operation. This increase appears to be due to the effect of the soldering process on the surface of the varistor between the electrodes. The effect is not eliminated by the cleaning of the surface which is conventionally performed after soldering. Not only is the initial leakage current of the device increased by the soldering process, but further, the tendency of the device to degrade after the prolonged application of working voltage thereto is increased by the detrimental effects of soldering.

In accordance with this invention, a solder-resistant protective layer 18 is applied to the periphery of varistor body 12 after the application of electrodes 14 and 16 thereto and prior to the soldering of electrical leads 20 and 22 to the electrodes. No particular method is required for applying protective layer 18, and those skilled in the art will recognize that many satisfactory methods may be employed. While other materials may provide satisfactory results, it is preferred in accordance with this invention to use silicone polyimide copolymer for protective layer 18. This material may easily be applied in an uncured liquid form by mounting the varistor pellet with electrodes affixed thereto to a rotating fixture and applying the silicone polyimide by means of a small brush or dropper. The protective layer is then cured by heating to a temperature of 125° C. or more but, preferably, to about 150° C. for one hour or more. Preferably, a second coat of polyimide may be applied in a similar manner and similarly cured. After the protective layer has been cured, leads 20 and 22 are attached to electrodes 14 and 16 by solder layers 24 and 26 which, for example, may comprise a eutectic lead-tin solder which also may include a small amount of silver. Such solders may be applied at a temperature of about 225° C. for about 10 minutes. While a number of different types of fluxes may be employed, it is preferred, in accordance with this invention, to employ a slightly acidic flux, one particular example of which is Alpha RMA 302, available from Alpha Metals, Jersey City, N.J. After soldering, the varistor, with leads attached, is cleaned, for example, in chlorothene by rinsing the soldered device one or more times. It is emphasized that while a particular soldering process is described which provides good results, this invention is not limited thereto and the benefits hereof may be obtained in many different varistors made by varying processes without the need for modifying existing processes.

The completed device is then packaged, for example, by providing an epoxy outer coating (not shown) which covers the entire device including protective layer 18. It has been found that in addition to preventing the degradation of the leakage characteristic during soldering, that the polyimide protective layer also increases the longterm stability of the device as has heretofore been deleteriously affected by the epoxies commonly utilized in encapsulating such devices.

Silicone polyimide copolymers are available in varied compositions. It is preferred in accordance with this invention to use a 30/70 ratio of polyimide to organic material having 50 percent solids. Curing of such a polyimide is accomplished at a temperature between about 125° and 400° C., preferably, below about 200° C.

Figure 2:
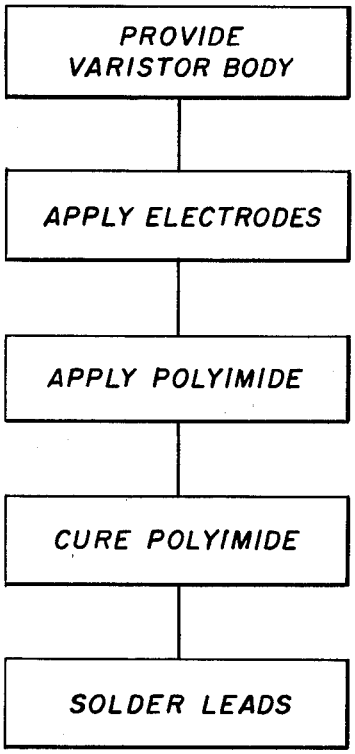
FIG. 2 is a flow-chart-type illustration of a method for forming a solderable varistor in accordance with this invention.

FIG. 2 illustrates in block diagram form the steps for practicing this invention. While the invention may be benefically practiced on many types of varistors, it is especially useful in conjunction with high voltage, high current varistors. A varistor body is provided which has, prior to the steps which form this invention, been sintered and which may, if desired, have previously been coated with a passivating coating such as that described in U.S. Pat. No. 3,857,174. Electrodes are applied to the body, for example, by silk-screening a silver paste in the area where electrodes are desired to be formed and firing the screened varistor body to form the silver electrodes. Such electroding is conventional and the particular steps thereof form no part of this invention. The protective coating of this invention is applied after the electrodes have been formed and covers the portion of the varistor body which is not covered by the electrodes and, preferably, a small portion of the electrodes themselves. Inasmuch as the degradation of the leakage characteristic of varistors during the soldering process appears to be a surface phenomenon rather than a bulk phenomenon, it is essential only that a continuous barrier between upper electrode 14 and lower electrode 16 be formed by protective coating 18. Protective coating 18 need not completely cover the periphery of the device including overlapping the upper and lower electrodes. However, it is preferred that the protective coating completely cover the periphery of the varistor body including slightly overlapping the upper and lower electrode so as to protect the entire nonelectroded portion of the varistor from the effects of the soldering operation including the effects of the fluxes used during soldering. Protective layer 18 may be applied in one or two or more applications, it being preferred to cure each layer prior to the application of a successive layer. After curing of the final layer, the device is then completed by conventional assembly, and leads 20 and 22 may be attached thereto by soldering, including the use of flux, and cleaning as is well known to those skilled in the art. Such soldering may include dipping the entire varistor including the portion covered by protective layer 18 into a solder bath, provided the temperature does not exceed about 400° C. After leads 20 and 22 are attached, the device may be packaged as, for example, by encapsulating in an epoxy, or the like.

The following table illustrates the improvement in leakage current measured after soldering for a varistor with the protective coating of this invention, and one without the protective coating:

| | Leakage $\mu\lambda$ | $\alpha_1$ | $\alpha_2$ | $\alpha_3$ | $V_1$ |
|---|---|---|---|---|---|
| Varistor without Protective Coating | 200 | 4 | 10 | 40 | 750 |
| Varistor with Protective Coating | 3.0 | 25 | 54 | 56 | 900 |

The leakage current is measured at $V_{\frac{1}{2}}$ volts; $\alpha_1$, $\alpha_2$, and $\alpha_3$ are measured between 0.1 and 1, 1 and 10, and 10 and 100 ma, respectively; and $V_1$ is the voltage across the varistor at a current of 1 ma. It will be seen that not only is the leakage current of the varistor much improved by the addition of a protective coating in accordance with this invention, but the other characteristics of the device are likewise improved.

Figure 3:
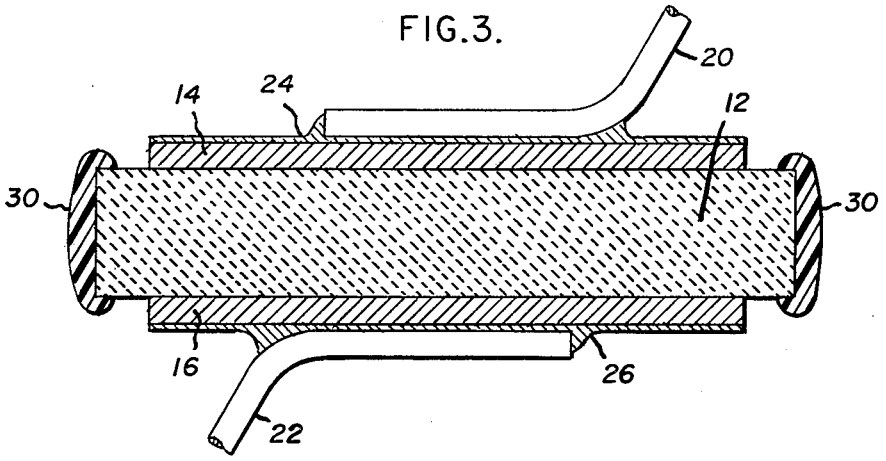
FIG. 3 is a view of a varistor in accordance with an alternative embodiment of this invention.

FIG. 3 illustrates a varistor in accordance with an alternative embodiment of this invention. In this and the following figures like elements are designated by like reference numerals. A varistor body 12 has first and second electrodes 14 and 16 attached to upper and lower major surfaces thereof. The formation of body 12 as well as the attachment of the electrodes thereto may be as hereinabove described in conjunction with FIG. 1. A protective layer 30 surrounds the periphery of body 12 but does not overlap electrodes 14 and 16. Layer 30 provides a barrier against the contamination during the soldering process of a surface path on body 12 between electrodes 14 and 16. Electrically conductive leads 20 and 22 are attached to electrodes 14 and 16, respectively, by solder layers 24 and 26 after the application of protective layer 30. It will be understood that both the application and curing of protective layer 30 and the soldering of leads 20 and 22 may be accomplished as hereinabove described in conjunction with FIG. 1. Conveniently, protective layer 30 may be formed by the application of a slightly smaller amount of silicone polyimide to the periphery of body 12 than is required to form a layer which covers not only the exposed periphery of body 12 but also a portion of electrodes 14 and 16.

Figure 4:
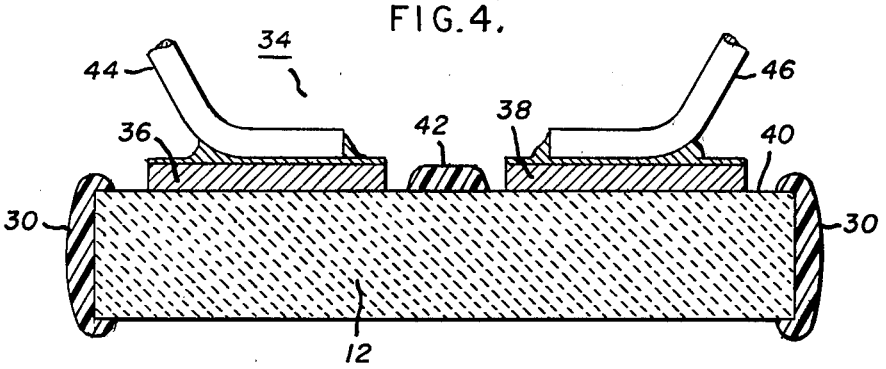
FIG. 4 is a view of a varistor in accordance with another alternative embodiment of this invention.

FIG. 4 illustrates an alternative embodiment of this invention having first and second electrodes applied to a single major surface thereof. Varistor 34 includes a body portion 12 having first and second electrodes 36 and 38 thereto and as hereinabove described in conjunction with FIGS. 1–3. Electrodes 36 and 38 are spaced apart and protective layer 42 is formed on surface 40 between the proximate edges of the electrodes. Electrically conducting leads 44 and 46 are soldered to electrodes 36 and 38, respectively, using the same process as has been hereinabove described. Similarly, protective layer 42 may be applied and cured as has been described except that it is of course not necessary or desirable to spin body 12 during the application of protective layer 42 which instead is preferably applied using a brush or other means for forming a stripe of material between the two electrodes. If desired, varistor 34 may also be provided with a peripheral protective layer 30 as was hereinabove described in conjunction with FIG. 3.

Figure 5:
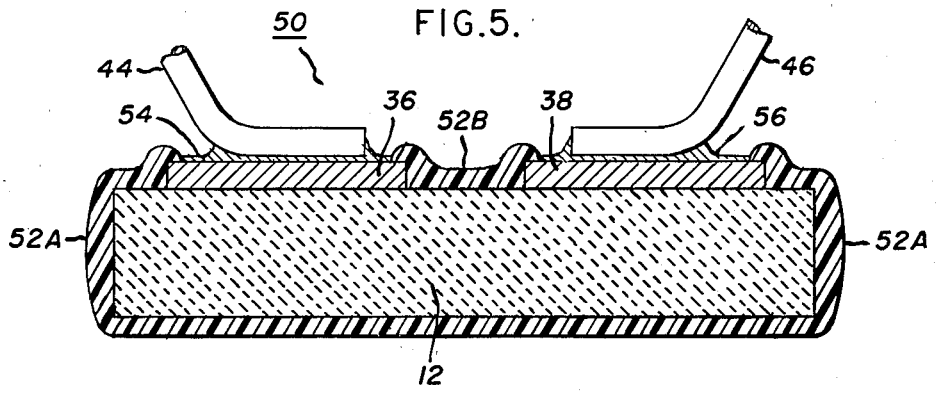
FIG. 5 is a view of a varistor in accordance with another alternative embodiment of this invention.

FIG. 5 illustrates a varistor of the type shown in FIG. 4 except that a protective coating covers not only the entire exposed surface of the varistor body, but a small portion of the electrodes as well. Varistor 50 includes a body 12 having first and second electrodes 36 and 38 formed on a single major surface thereof and which includes a layer of protective material 52 comprising an outer peripheral region 52A and an inner region 52B which is an extension of peripheral region 52A lying between electrodes 36 and 38. Electrically conductive leads 44 and 46 are connected to the electrodes 36 and 38 by solder layers 54 and 56, respectively.

This invention provides a solderable varistor and a method for the fabrication thereof which exhibits a greatly improved leakage current as well as other characteristics over devices of the prior art. While the invention has been described in conjunction with several presently preferred embodiments thereof, those skilled in the art will appreciate that various modifications and changes may be made without departing from the true spirit and scope of the invention. For example, the silicone polyimide presently employed for forming the protective coating may be modified by changing the precise composition thereof as has been described. Further, other solder and flux resistant coatings may provide the same advantages. The particulars of the method for applying the coating to a varistor may vary with the type of varistor and the package in which it will ultimately be provided. Accordingly, the scope of the invention is not intended to be limited by the foregoing particular description thereof but only by the appended claims.

What is claimed is:

1. A metal oxide varistor having low leakage comprising:

a body consisting essentially of metal oxide and at least one additive;

first and second spaced apart electrodes applied directly to said body;

a protective layer of polyimide silicone on the surface of said body between said electrodes and covering the edges of said electrodes, said layer being resistant to solder and solder-borne contaminants and having respective openings therein exposing and defining a solder attachment region on the surface of each of said electrodes;

each of said electrodes having on its exposed surface a respective layer of solder;

and first and second electrically conductive leads connected respectively to said first and second electrodes by said respective layers of solder.

* * * * *

UNITED STATES PATENT OFFICE

CERTIFICATE OF CORRECTION

PATENT NO. : 4 371 860

DATED : 2/1/83

INVENTOR(S) : John E. May; Steven R. Zohler

It is certified that error appears in the above-identified patent and that said Letters Patent are hereby corrected as shown below:

Column 4, line 10, change "chlorothene" to -- chlorethene"

IN THE CLAIMS:

Claim 1, column 6, line 51, change "polyimide silicone" to --silicone polyimide--

Signed and Sealed this

*Seventh* Day of *June 1983*

[SEAL]

*Attest:*

DONALD J. QUIGG

*Attesting Officer*

*Acting Commissioner of Patents and Trademarks*